US005511391A

United States Patent [19]

Verstraeten

[11] Patent Number: 5,511,391

[45] Date of Patent: Apr. 30, 1996

[54] ORNAMENTAL GEM AND METHOD OF MANUFACTURING THE SAME

[75] Inventor: Hubert Verstraeten, Luxembourg, Luxembourg

[73] Assignee: Gebrüder Niessing GmbH & Co., Vreden, Germany

[21] Appl. No.: 204,118

[22] Filed: Mar. 1, 1994

[30] Foreign Application Priority Data

Mar. 10, 1993 [DE] Germany ..... 9304010 U

[51] Int. Cl.[6] ..... A44C 9/00; B23P 13/00

[52] U.S. Cl. ..... 63/15; 29/8

[58] Field of Search ..... 63/DIG. 3, 15, 63/15.4, 26; D11/3, 37, 39, 38; 29/8, 160.6

[56] References Cited

U.S. PATENT DOCUMENTS

| | | | |
|---|---|---|---|
| 89,240 | 2/1933 | Kagan | 63/15 |
| 728,827 | 5/1903 | Anthony | 63/15 |
| 837,615 | 12/1906 | Dover | 63/26 |
| 1,972,128 | 9/1934 | Bobbroff | 63/15 |
| 2,027,060 | 1/1936 | Niven et al. | 63/15 |
| 2,596,965 | 5/1952 | Troy | 63/26 |
| 2,859,971 | 11/1958 | Grant et al. | 63/15.4 |
| 2,920,442 | 1/1960 | Kunzmann et al. | 63/28 |
| 4,114,398 | 9/1978 | Orlandini | 63/15 |
| 4,493,196 | 1/1985 | Bogner et al. | 63/15 |
| 4,716,750 | 1/1988 | Tizzi | 29/160.6 |

*Primary Examiner*—Michael J. Milano
*Attorney, Agent, or Firm*—Anderson Kill Olick & Oshinsky

[57] ABSTRACT

An ornamental ring-shaped metal gem formed of a wire maze, and produced by a process including forming, on a mandrel, a wire weave having a length exceeding a thickness of the manufactured gem, thereafter inserting the mandrel, together with the wire weave into a tubular element of a die, which also includes a cylindrical bottom portion supporting the tubular element and defines a stop surface for the mandrel, and applying pressure to the wire weave to form the gem.

4 Claims, 4 Drawing Sheets

FIG.16
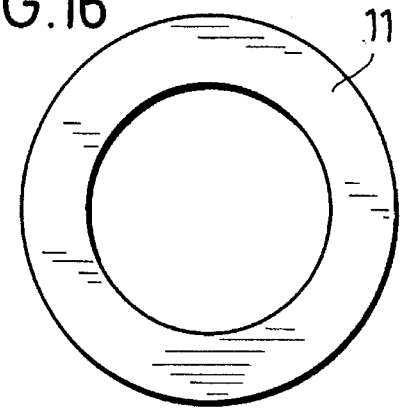
FIG.18
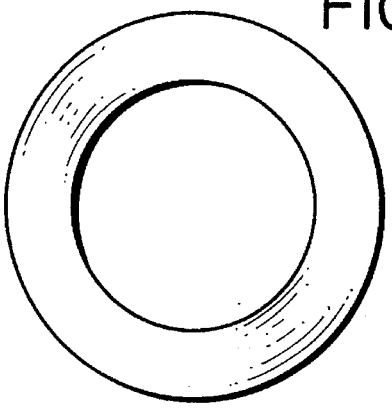
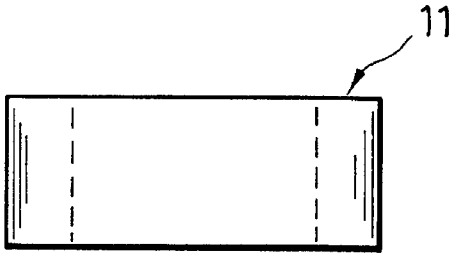
FIG.17
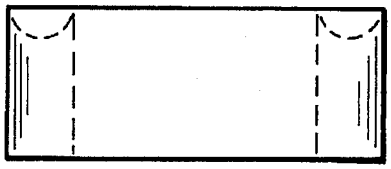
FIG.19
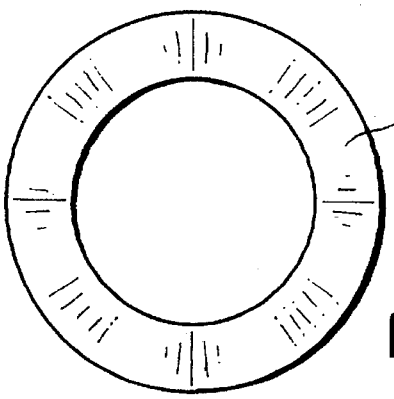
FIG.20
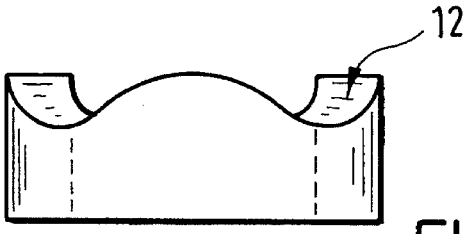
FIG.21

ORNAMENTAL GEM AND METHOD OF MANUFACTURING THE SAME

FIELD OF THE INVENTION

The present invention is directed to an ornamental gem as well as to an ornamental gem manufacturing process. Particularly, the present invention is directed to an ornamental gem made from metal and to the manufacture of the same.

BACKGROUND OF THE INVENTION

Gems of varied shapes are, of course, well known. For instance, DE-A-31 04 396 discloses annular bands made of solid metal. DE-C-38 27 984 discloses dividable annular bands fabricated from flat materials. Rings made from hollow members are disclosed, for instance, in DE-55 808. Ornamental gems with jacketed core threads are disclosed U.S. Pat. No. 3,667,098. Gems with ornamental element links displaceable with respect to one another are, for instance, disclosed in U.S. Pat. No. 4,362,031. A multiplicity of other examples are found in the state of the art.

It is however an object of the present invention to provide an ornamental gem, having a visual appearance differing from what has been previously known and a method of manufacturing the same by shaping of the ornamental gem by the disclosed method.

SUMMARY OF THE INVENTION

This and other objectives of the invention, which shall become hereafter apparent, are achieved by providing an ornamental gem, formed from a compressed maze of wires. Such gems can be manufactured by forming a snarled ball from easily, plastically deformable wire, suitable for this purpose and by compressing the snarled ball tightly in a compression die, whose cavity defines the contour shape of the gem. The die compacts the gem by plastic deformation of the wire material, wherein the numerous cavities in the snarled ball largely disappear. Thereby, an ornamental piece is obtained, whose surface, defined by the compression die, is not smooth, but furrowed, since gaps remain between the wire windings, providing a very impressive, vivid and original aspect to the surface.

The shaping possibilities of the cavity of the compression die is virtually limitless, as is the contour or surface outline of the ornament. The cavity of the compression die can comprise one or more planar, cylindrical, cone-shaped, spherically-shaped, smooth, corrugated or serrated surface regions.

The ornament should be sufficiently dense in order to enable a tangled course of the wires to have adequate cohesion in the compressed state. It is particularly favorable for the cohesion, if a weave or braid is formed out of the wire prior to compression. It is also particularly advantageous that the weave not be made especially dense or uniform. Rather, a very coarse irregular weave suffices, since the external shape of the gem is not defined by the weave, but by the compression die in which the weave is compressed and compacted. Apart from that, an irregular weave has the advantage that the surface of the ornament presents an irregular, vivid and not a dull structure. Wires having a diameter between 0.3 mm and 1.3 mm, preferably 0.7 to 1 mm, are suitable for this purpose.

Wires having different thicknesses, cross-sectional shapes (e.g. circular, oval, triangular, four cornered) and wires made from different materials can be used for manufacturing the inventive ornamental gem. However, gold and silver are the preferred precious metals for manufacturing the gem. Pure gold can also be processed, preferably in a soft state. Due to the plastic deformation during compression, the material becomes hard and the ornament becomes inherently Stable. Precious metals such as platinum, which can, at least, be easily slightly deformed plastically, can also be used. A suitable non-precious metal, which can be used for manufacturing the gem, is copper. Plastics material faces can also be inserted.

It is possible to obtain surfaces with a particularly pleasant aspect, if the gaps existing in the compressed ornaments are filled with a material whose appearance contrasts from that of the material of the wire. In this connection, enamels of different colors are particularly suited for ornament purposes. The intermediate spaces remaining in the ornament can be impregnated with enamel. Remaining excess of the hardened enamel can be removed by cutting. In this way, certain pleasant contrasts for instance by black, red, green or blue enamel in a silver weave or by white enamel in a gold weave can be achieved.

BRIEF DESCRIPTION OF THE DRAWINGS

The invention will be better understood, by the Detailed Description of the Preferred Embodiment, in connection with the drawings, of which:

FIGS. 8 to 21 show different die parts on a magnified scale compared to FIGS. 1 to 7, which can be inserted as a bottom die part and/or a top die part into the die shown in FIGS. 1 to 4.

DETAILED DESCRIPTION OF THE PREFERRED EMBODIMENT

Figure 1:
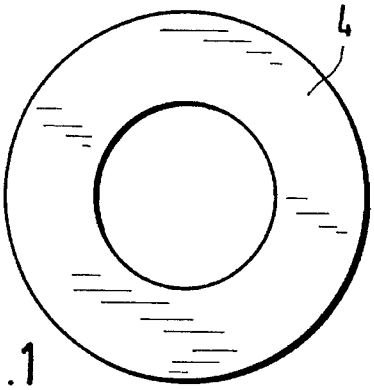
FIG. 1 is a plan view of a compression die for the fabrication of an ornamental gem, showing a tubularly shaped outer portion of the die.
Figure 2:
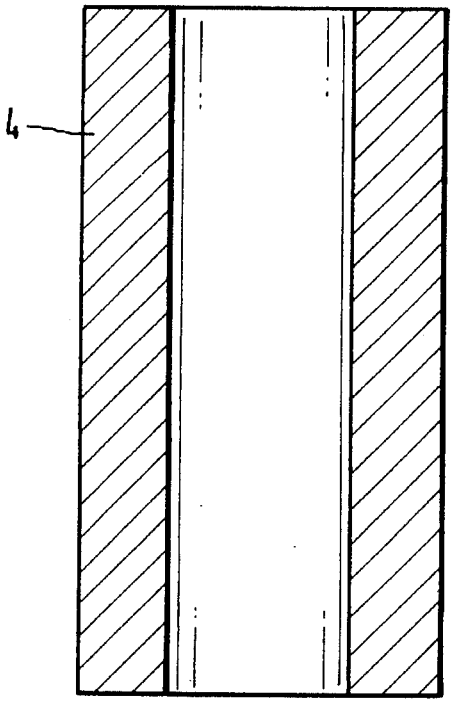
FIG. 2 is a longitudinal sectional view of the tubularly shaped outer portion of the die.
Figure 3:
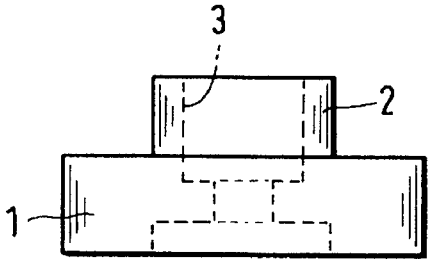
FIG. 3 is a side view of the lower portion of the compression die.
Figure 4:
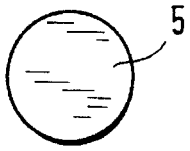
FIG. 4 is a plan view of a cylindrical internal mandrel for the compression die.
Figure 5:
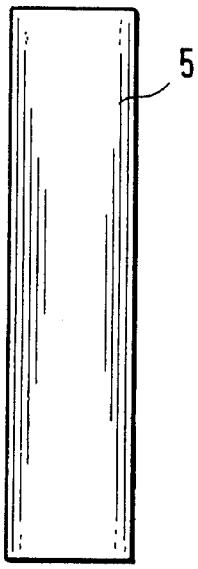
FIG. 5 is a side view of the cylindrical internal mandrel.
Figure 6:
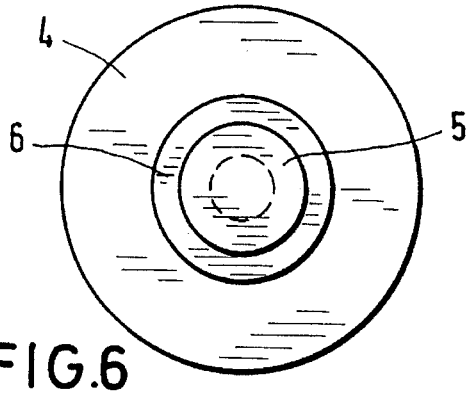
FIG. 6 is a plan view of the lower portion, with the mandrel inserted.
Figure 7:
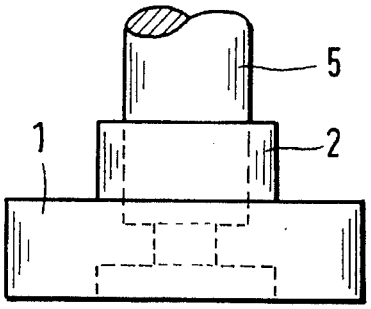
FIG. 7 is a side view of the lower portion of the inserted mandrel.

Referring now to the drawings, wherein like numerals reflect like elements, throughout the several views, FIG. 1 shows a compression die fabricated from tool steel and comprising a cylindrical bottom portion 1, with a cylindrical extension 2 of smaller diameter concentric to the bottom portion 1, with both of them comprising a continuous, stepped axial bore 3. The bottom portion 1 receives an outer tubular element 4 of the mold, which is centered by the extension 2, which engages into the tubular element with a close fit.

A cylindrical rod 5, serving as mandrel, is inserted into the bore 3 of the bottom part up to the stop, upon which die parts of the type shown in FIGS. 8 to 21 can be stacked in a row.

The die parts fit precisely into the annular space 6 between the rod 5 and the tubular element 4.

Prior to inserting the rod 5, it is surrounded by a wire weave. The length of wire is predetermined by the volume of the ring. For instances, 250 cm of 1 mm thick silver wire can be used and coiled in a looped-shaped or meander-shaped manner around the rod 5, so that the loops extending in axial direction are, for instance, about 4 cm long.

The wire is wound in such a way around the rod 5, that approximately half the wire length is used up in order to surround the rod in loop-shaped manner. The other half of the wire length is used to interweave the loops to one another. For this purpose, the remaining length of wire is alternately coiled over and under the wire windings, wherein the wire is guided several times, at different levels, around the rod. The start and end of the wire is placed in such a way in the weave formed in this manner that they lie as far as possible towards the inside in the ensuing ring.

Now two mold parts are placed upon the rod 5, provided with the net-like weave (as they are shown in FIGS. 8 to 21), serving as a bottom die and as a top die. The bottom die can be eliminated, if the bottom side of the ring is to be planar, because the extension 2 of the bottom part 1 can then serve as a bottom die.

A pressure tube is then placed upon the mold part, serving as a top die, which is introduced into the annular space. This pressure tube is pressed down hydraulically, or by a lever mechanism and the weave is thereby upset, compacted and work-hardened with simultaneous considerable plastic deformation of the wire.

The shape of the bottom die and/or the top die used depends solely upon the desired shape of the ring.

Figure 8:
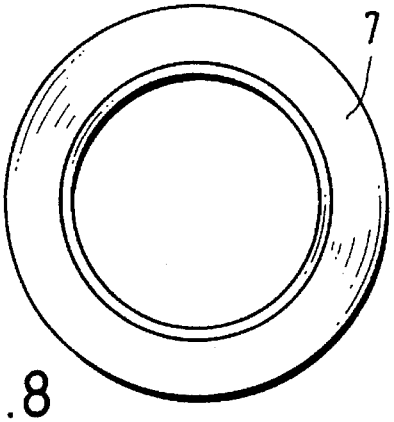
Figure 10:
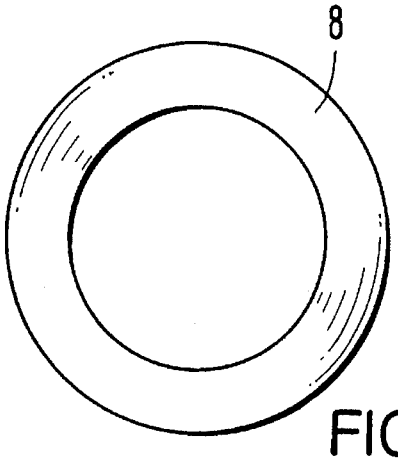
Figure 9:
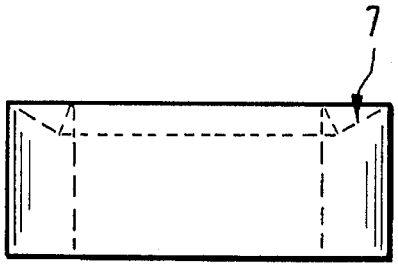
Figure 11:
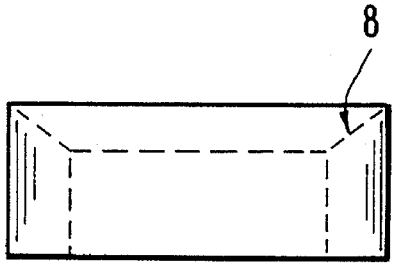
Figure 12:
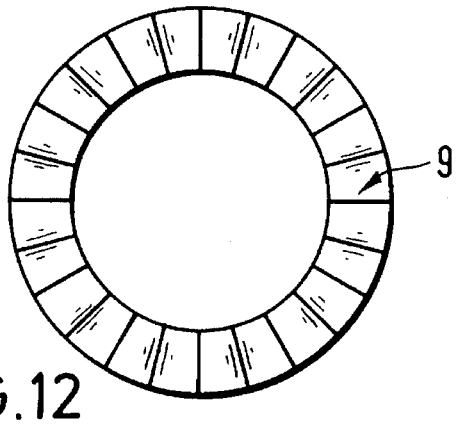
Figure 14:
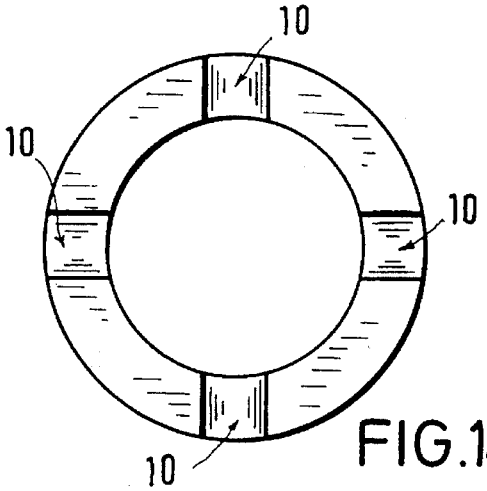
Figure 13:
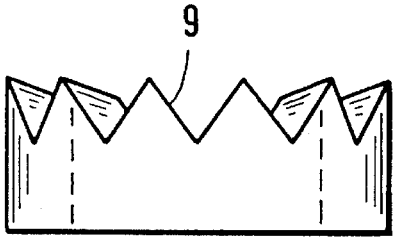
Figure 15:
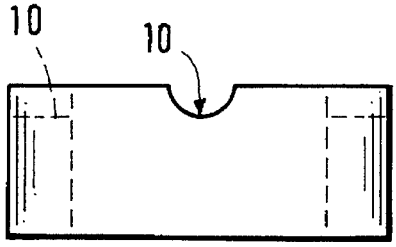

The die part shown in FIGS. 8 and 9 yields rings with a flank 7, beveled in a roof-shaped manner. The die part shown in FIGS. 10 and 11 produce rings with a simply beveled flank 8. The die part shown in FIGS. 12 and 13 produces rings with a jagged flank 9. The die part shown in FIGS. 14 and 15 produces rings with a flank carrying saddles 10 in a cross-wise disposition. The die part shown in FIGS. 16 and 17 produces rings with planar flanks, which extends at a right angle to the axis of the cylinder. The flatness of the flank however does not mean that it is smooth. Rather, it is furrowed by the intertwined run of the wire visible in the flank. However, there exists a planar tangential face for the flank, which is precisely the flank 11 of the die part (FIG. 16).

Figure 22:
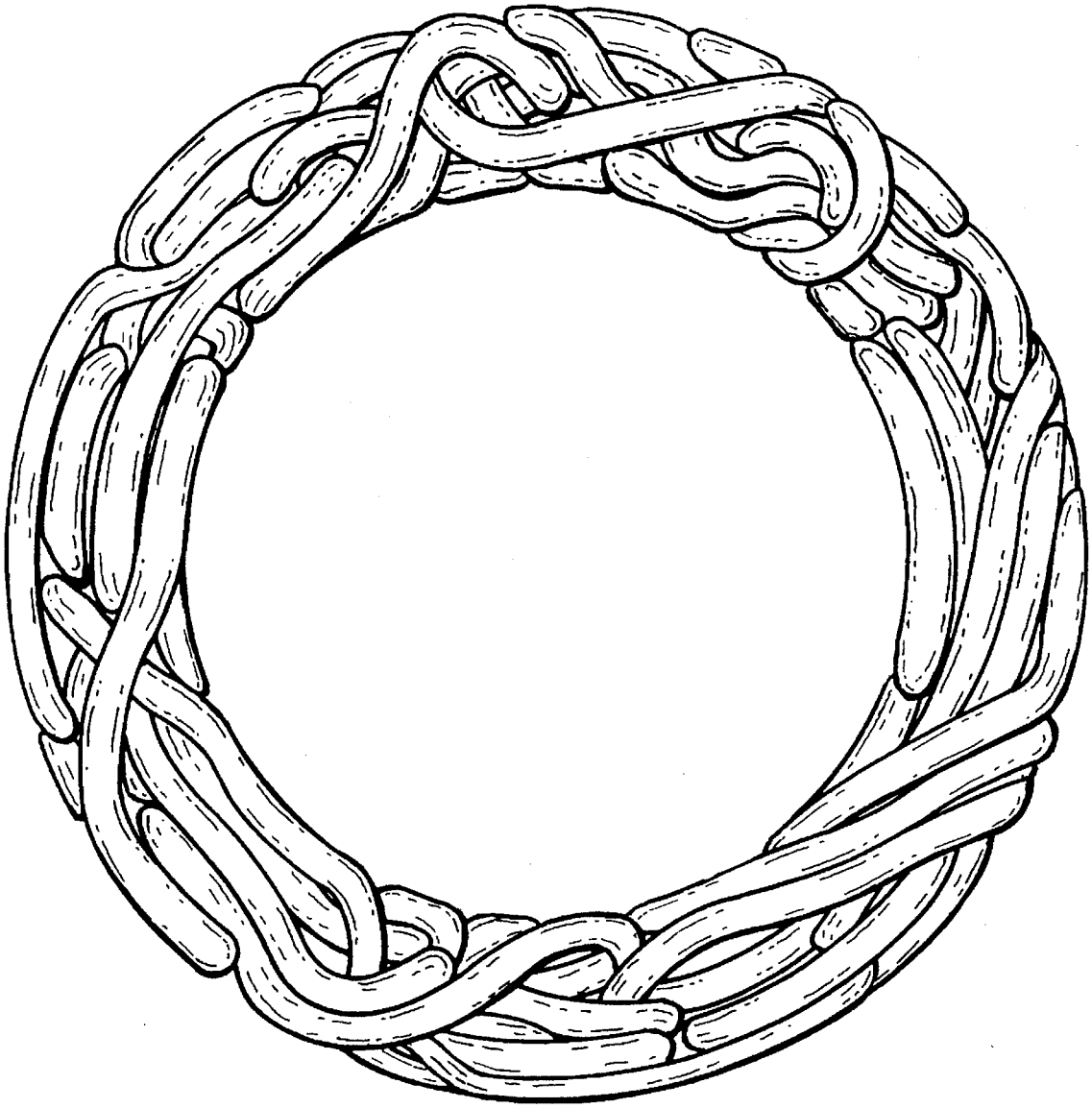
FIG. 22 depicts a plan view of a ring greatly magnified fabricated therewith.

The die part shown in FIGS. 18 and 19 produces a ring with rounded cross-section. Such a ring is shown greatly magnified in FIG. 22. The mold part shown in FIGS. 20 and 21 produces a ring with an undulating or corrugated flank 12.

While the preferred embodiments of the invention have been disclosed in detail, modifications and adaptations may be made thereto, without departing from the spirit and scope of the invention, as delineated in the following claims:

What is claimed is:

1. A method of manufacturing an ornamental ring-shaped metal gem formed of a wire maze, said method comprising the steps of:

providing die means including a cylindrical bottom portion, an outer tubular element supported on said bottom portion, and a mandrel insertable into said tubular element and supported on said bottom portion against a stop surface, said mandrel having an outer diameter smaller than an inner diameter of said tubular element by an amount corresponding to a width of the wire maze of which the ring-shaped metal gem is formed;

forming, on said mandrel, a wire weave having a length exceeding a thickness of the manufactured ring-shaped metal gem;

thereafter, inserting said mandrel, together with the wire weave, into said tubular element; and applying pressure to the wire weave to form the ring-shaped metal gem.

2. The method of claim 1, wherein said wire weave forming step comprises:

providing a wire having a predetermined length;

wrapping said mandrel with about a half of the wire length in a loop-like manner to form a plurality of loops; and interweaving the loops with a remaining portion of the wire length.

3. The method of claim 1, wherein said die means providing step comprises providing die means, the cylindrical bottom portion of which includes a surface against which the wire weave is compressed and which has one of structured, wavy and jagged shapes.

4. An ornamental ring-shaped metal gem formed of a wire maze and produce by a process including:

providing die means including a cylindrical bottom portion, an outer tubular element supported on said bottom portion, and a mandrel insertable into said tubular element and supported on said bottom portion against a stop surface, said mandrel having an outer diameter smaller than an inner diameter of said tubular element by an amount corresponding to a width of the wire maze of which the ring-shaped metal gem is formed;

foaming, on said mandrel, a wire weave having a length exceeding a thickness of the manufactured ring-shaped metal gem;

thereafter, inserting said mandrel, together with the wire weave, into said tubular element; and applying pressure to the wire weave to form the ring-shaped metal gem.

* * * * *